US007163425B2

(12) United States Patent
Kamio

(10) Patent No.: US 7,163,425 B2
(45) Date of Patent: Jan. 16, 2007

(54) PERSONAL WATERCRAFT

(75) Inventor: Kunihiko Kamio, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 11/131,939

(22) Filed: May 17, 2005

(65) Prior Publication Data

US 2005/0255760 A1 Nov. 17, 2005

(30) Foreign Application Priority Data

May 17, 2004 (JP) ..... 2004-145881

(51) Int. Cl.
*B63H 21/22* (2006.01)

(52) U.S. Cl. ..... 440/1; 114/285

(58) Field of Classification Search ..... 440/1, 440/84, 87; 114/126, 275, 285, 286
See application file for complete search history.

(56) References Cited

U.S. PATENT DOCUMENTS 5,385,110 A * 1/1995 Bennett et al. ..... 114/285
5,474,012 A * 12/1995 Yamada et al. ..... 114/286
6,508,187 B1 * 1/2003 Maeda et al. ..... 114/126
6,663,446 B1 * 12/2003 Bernier et al. ..... 440/1
7,037,147 B1 * 5/2006 Kinoshita et al. ..... 440/1

FOREIGN PATENT DOCUMENTS

JP 2001-191992 7/2001

* cited by examiner

*Primary Examiner*—Lars A. Olson
(74) *Attorney, Agent, or Firm*—Alleman Hall McCoy Russell & Tuttle LLP

(57) ABSTRACT

A personal watercraft configured to plane on a water surface is disclosed. The personal watercraft typically includes an attitude sensor configured to detect an attitude of a body of the watercraft, a propulsion force changing system configured to change a propulsion force of the watercraft to control the attitude of the body, and a controller configured to control the propulsion force changing system according to the attitude of the body which is detected by the attitude sensor.

10 Claims, 11 Drawing Sheets

PERSONAL WATERCRAFT

BACKGROUND OF THE INVENTION

1. Field of the Invention

The present invention generally relates to personal watercraft, and more particularly relates to propulsion control based on detected attitude of a personal watercraft.

2. Description of the Related Art

Typically, water-jet propulsion personal watercraft have a relatively small body including a hull and a deck covering the hull from above which are joined to each other. An engine is mounted in an inner space of the body. The engine is configured to drive a water jet pump configured to propel the watercraft, which pressurizes and accelerates water sucked through a water passage from a water intake generally provided on a hull bottom surface, and ejects it rearward from an outlet port. As a result, the personal watercraft is propelled.

Since the personal watercraft has a relatively small body as described above, it may have various travel attitudes depending on a reaction force of a water jet ejected from the water jet pump or an operating attitude of a rider. For example, when the rider performs an operation to quickly open a throttle to a great degree to gain a large propulsion force of the watercraft, a front part of the body tends to tilt upward. When the rider operates a steering handle to a great extent to perform a sharp turn, the watercraft body tends to bank in a steering direction.

However, with the front part of the body tilting upward to a great extent, the propulsion force being generated by the water jet pump is not efficiently utilized to accelerate the watercraft in a direction in which the watercraft is traveling, and therefore, a desired acceleration is not achieved. If the watercraft banks to a great extent during the turn, the water intake on the hull bottom surface is exposed above the water surface, and air enters the water jet pump through the water passage. As a result, the propulsion force of the watercraft may decrease.

In the water-jet propulsion personal watercraft, a steering nozzle is disposed behind an impeller of the water jet pump. By pivoting the steering nozzle clockwise or counterclockwise, a water jet ejected from the water jet pump is changed to turn the watercraft. With the throttle in a fully closed position, the water jet ejected from the water jet pump is little, making it difficult to turn the watercraft.

By way of example, Japanese Laid-Open Patent Application Publication No. 2001-191992 discloses a steering assist function to assist in enhancing steering function when the throttle is in a fully closed position and thereby the steering function degrades. More specifically, steering tabs (movable tabs) which are movable and are capable of being submerged in water, are caused to provide different propulsion resistances to the right and to the left to assist in turning the watercraft.

In the above configuration, however, since the steering tabs are typically configured to cooperate with the steering handle, they may provide an undesired turning capability during travel in medium and high speed ranges, if the watercraft is configured to fully perform the steering assist function during low-speed travel.

SUMMARY OF THE INVENTION

The present invention addresses the above described conditions, and an object of the present invention is to provide a personal watercraft that is configured to control an engine speed of the engine or a movable tab based on a body attitude of the watercraft to thereby enhance travel capability and to provide improved riding comfort to a rider.

According to the present invention, there is provided a personal watercraft configured to plane on a water surface, comprising: an attitude sensor configured to detect an attitude of a body of the watercraft; a propulsion force changing system configured to change a propulsion force of the watercraft to control the attitude of the body; and a controller configured to control the propulsion force changing system according to the attitude of the body which is detected by the attitude sensor. In such a construction, since the propulsion force given to the body of the watercraft is changed using the attitude of the body as a parameter to, for example, inhibit further change in the attitude of the body, improved travel and turn capabilities are achieved in the personal watercraft.

The propulsion force changing system may include a movable tab configured to change propulsion resistance which is generated by contact with water and applied to the watercraft. For example, right and left tabs are mounted to a rear portion of the hull and are driven to be vertically pivotable according to the attitude of the watercraft so that the water resistance applied to the body may vary according to the positions of the tabs. Accordingly, the propulsion force changing system may be of a relatively simple construction.

The controller may be configured to control the movable tab to increase the propulsion resistance applied to the watercraft when the attitude sensor detects that a front part of the body is tilting upward by a predetermined amount or more. In this construction, the watercraft can be accelerated efficiently by using the propulsion force generated by the water jet pump while inhibiting upward tilting of the front part of the body to a great extent during acceleration.

The controller may be configured to control the movable tab to inhibit further downward tilting of the front part of the body when the attitude sensor detects that the front part of the body is tilting downward by a predetermined amount or more. In this construction, downward tilting of the front part of the body to a great extent is inhibited during deceleration, and thus the rider can feel improved riding comfort.

The controller may be configured to control the movable tab to inhibit further bank of the body when the attitude sensor detects that the body is banking by a predetermined amount or more. In such a construction, it is possible to inhibit reduction of the propulsion force of the watercraft, which would otherwise be caused by entry of air into the water jet pump through a water passage with the water intake on the hull bottom surface exposed above the water surface.

The personal watercraft may further comprise an engine configured to drive a water jet pump configured to generate a propulsion force of the watercraft; a throttle sensor configured to detect that an operation for fully closing a throttle of the engine has been performed; and a steering sensor configured to detect that the steering system has been steered by a predetermined operation amount or more, wherein the controller is configured to control the movable tab to increase the propulsion resistance applied to the body in a direction in which the body is steered to assist in steering, when the throttle sensor detects that the operation for fully closing the throttle has been performed and the steering sensor detects that the steering system has been steered by the predetermined operation amount or more. The controller may be configured to further control the movable tab to decrease the propulsion resistance applied to the body when the attitude sensor detects that the front part of the body is tilting downward by a predetermined amount or more.

The personal watercraft may further comprise an engine configured to drive a water jet pump configured to generate a propulsion force of the watercraft; a throttle sensor configured to detect that an operation for fully closing a throttle of the engine has been performed; and a steering sensor configured to detect that a steering system has been steered by an operation amount or more. The controller may be configured to control the movable tab to increase a propulsion resistance applied to the body in a direction in which the body is steered to assist in steering when the throttle sensor detects that the operation for fully closing the throttle has been performed and the steering sensor detects that the steering system has been steered by the predetermined operation amount or more. The controller may be configured to further control the movable tab to decrease the propulsion resistance applied to the body in a direction in which the body is banking when the attitude sensor detects that the body is banking by a predetermined amount or more.

The propulsion force changing system may include a water jet pump configured to be driven by an engine to generate the propulsion force of the watercraft. Since the propulsion force of the watercraft which is generated by the water jet pump can be changed by increasing or decreasing the engine speed without a need for a propulsion force changing system independently provided, an increase in the number of components of the watercraft and the resulting weight increase are inhibited.

The controller may be configured to control the engine to decrease the propulsion force of the watercraft which is generated by the water jet pump when the attitude sensor detects that the front part of the body is tilting upward by a predetermined amount or more. In this construction, the watercraft is efficiently accelerated by using the propulsion force generated by the water jet pump while inhibiting upward tilting of the front part of the body to a great extent during acceleration.

The controller may be configured to control the engine to increase the propulsion force of the water which is generated by the water jet pump when the attitude sensor detects that the front part of the body is tilting downward by a predetermined amount or more. In this construction, downward tilting of the front part of the body to a great extent is inhibited during deceleration, and thus the rider can feel improved riding comfort.

The controller may be configured to control the engine to decrease the propulsion force of the watercraft which is generated by the water jet pump to inhibit further bank of the body when the attitude sensor detects that the body is banking by a predetermined amount or more. In this case, lateral overturn of the body can be inhibited, and thus, the rider can feel improved riding comfort during turn.

The personal watercraft may further comprise a throttle sensor configured to detect that an operation for fully closing the throttle of the engine has been performed; and a steering sensor configured to detect that a steering system has been steered by a predetermined operation amount or more. The controller may be configured to control the engine to increase an engine speed when the throttle sensor detects that the operation for fully closing the throttle has been performed and the steering sensor detects that the steering system has been steered by the predetermined operation amount or more. The controller may be configured to further control the engine to increase the engine speed when the attitude sensor detects that the front part of the body is tilting downward by a predetermined amount or more.

The personal watercraft may further comprise a throttle sensor configured to detect that an operation for fully closing a throttle of the engine has been performed; and a steering sensor configured to detect that a steering system has been steered by a predetermined operation amount or more. The controller may be configured to control the engine to increase an engine speed to assist in steering when the throttle sensor detects that the operation for fully closing the throttle has been performed and when the steering sensor detects that the steering system has been steered by the predetermined operation amount or more. The controller may be configured to further control the engine to decrease the engine speed when the attitude sensor detects that the body is banking by a predetermined amount or more.

The propulsion force changing system may include a movable tab configured to change propulsion resistance generated by contact with water and applied to the watercraft, and a water jet pump configured to be driven by an engine to generate the propulsion force of the watercraft. In such a construction, since the movable tab and the water jet pump enable the attitude of the body to be controlled flexibly and effectively, the travel and turning capabilities of the watercraft can be further improved.

The controller may be configured to control the movable tab to increase the propulsion resistance applied to the watercraft and to control the engine to decrease the propulsion force of the watercraft which is being generated by the water jet pump when the attitude sensor detects that the front part of the body is tilting upward by a predetermined amount or more.

The controller may be configured to control the movable tab to inhibit further downward tiling of the front part of the body and to control the engine to increase the propulsion force of the watercraft which is being generated by the water jet pump when the attitude sensor detects that the front part of the body is tilting downward by a predetermined amount or more.

The controller may be configured to control the movable tab to inhibit further bank of the body and to control the engine to decrease the propulsion force of the watercraft which is being generated by the water jet pump when the attitude sensor detects that the body is banking by a predetermined amount or more.

The personal watercraft may further comprise a throttle sensor configured to detect that an operation for fully closing a throttle of the engine has been performed; and a steering sensor configured to detect that a steering system has been steered by a predetermined operation amount or more. The controller may be configured to control the movable tab to increase propulsion resistance applied to the body in a direction in which the body is steered to assist in steering, or to control the engine to increase the engine speed when the throttle sensor detects that the operation for fully closing the throttle has been detected and the steering sensor detects that the steering system has been steered by the predetermined operation amount or more. The controller may be configured to further control the movable tab to decrease the propulsion resistance applied to the body and to control the engine to increase the engine speed when the attitude sensor detects that the front part of the body is tilting downward by a predetermined amount or more.

The personal watercraft may further comprise a throttle sensor configured to detect that an operation for fully closing a throttle of the engine has been performed; and a steering sensor configured to detect that a steering system has been steered by a predetermined operation amount or more. The controller may be configured to control the movable tab to increase the propulsion resistance applied to the body in a direction in which the body is steered to assist in steering or to control the engine to increase the engine speed when the throttle sensor detects that the operation for fully closing the throttle has been performed and the steering sensor detects that the steering system has been steered by the predetermined operation amount or more. The controller may be configured to further control the movable tab to decrease propulsion resistance applied to the body in a direction in which the body is banking and to control the engine to decrease the engine speed when the attitude sensor detects that the body is banking by a predetermined amount or more.

The above and further objects and features of the invention will more fully be apparent from the following detailed description with accompanying drawings.

DETAILED DESCRIPTION OF THE PREFERRED EMBODIMENTS

Figure 1:
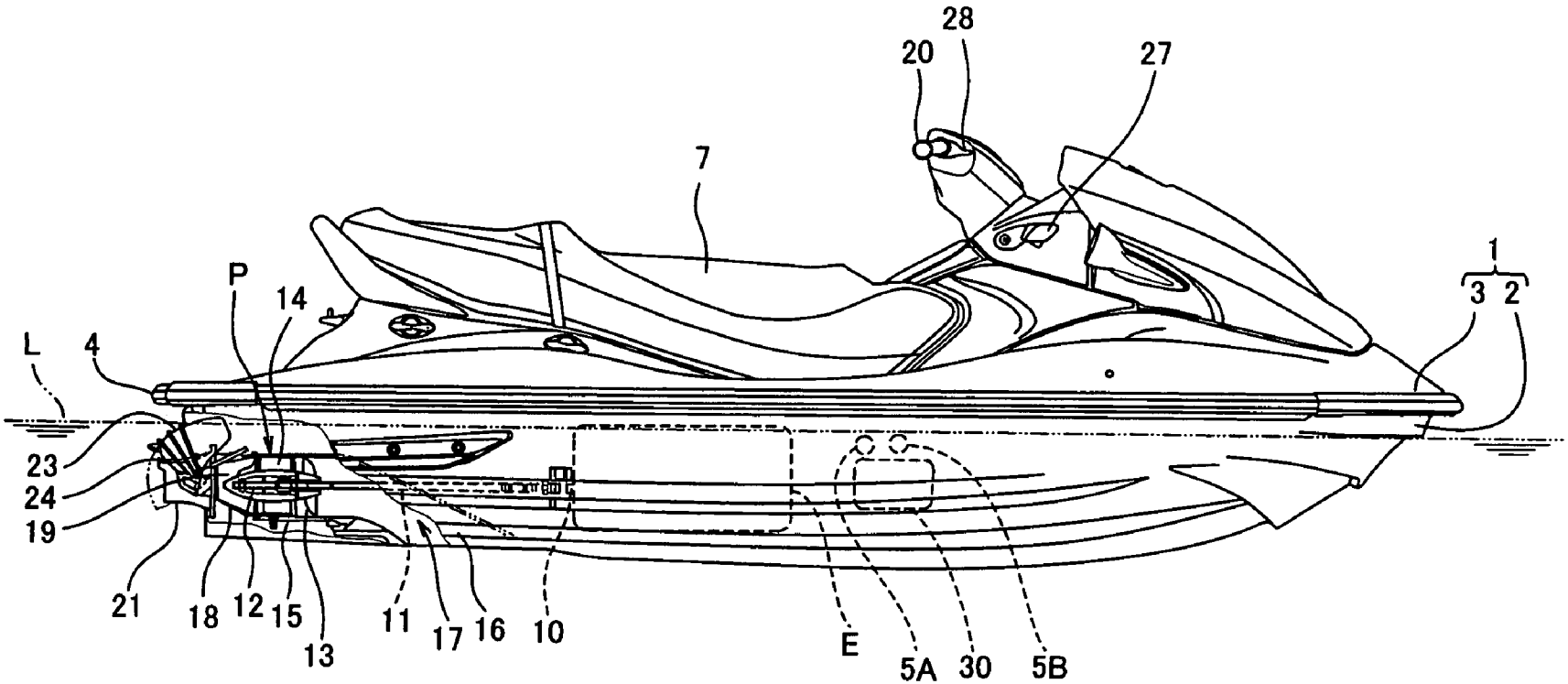
FIG. 1 is a side view showing an entire construction of a personal watercraft according to an embodiment of the present invention.
Figure 2:
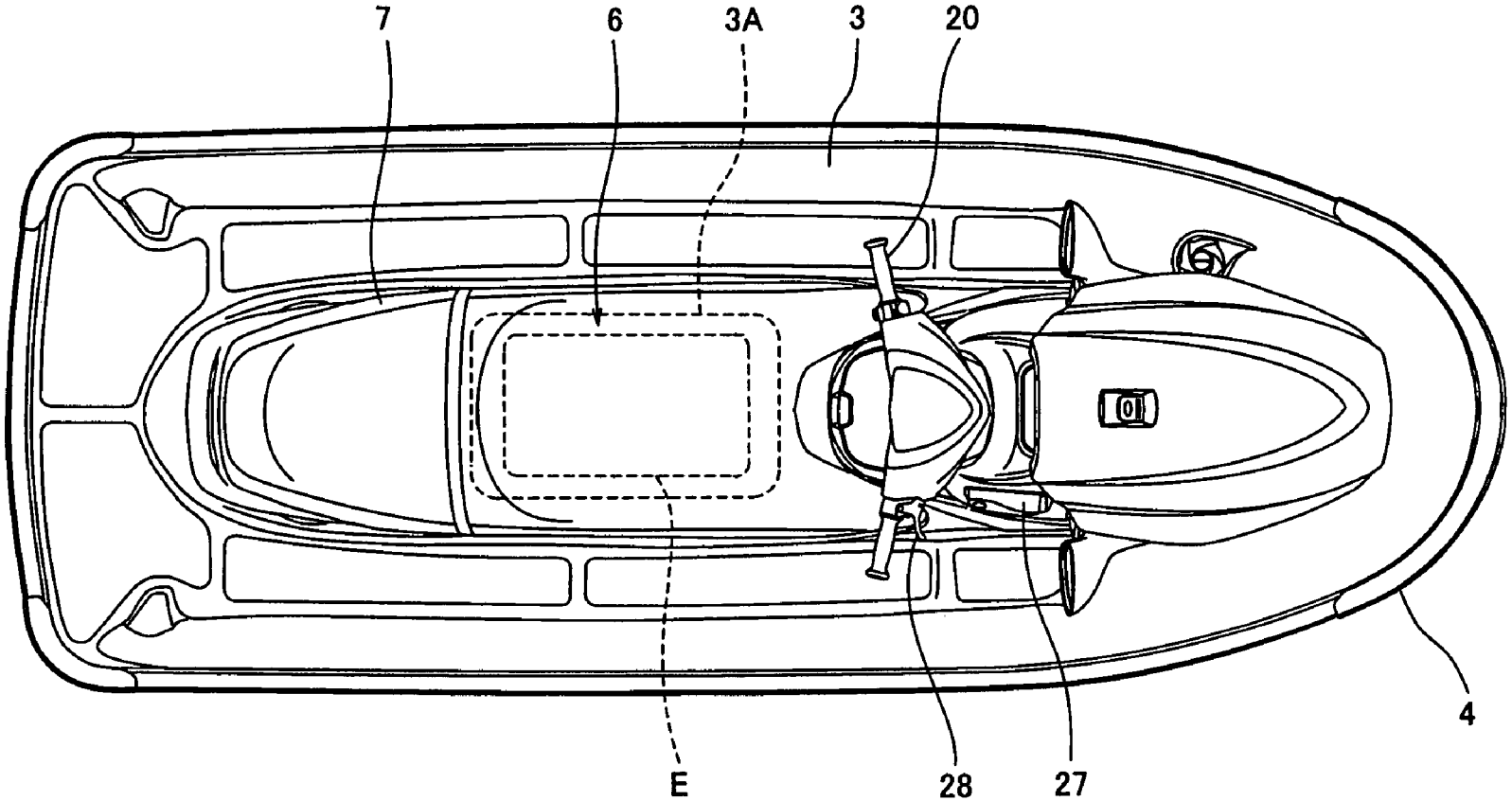
FIG. 2 is a plan view of the personal watercraft of FIG. 1.

FIG. 1 is a side view showing an entire construction of a water-jet propulsion personal watercraft according to an embodiment of the present invention. FIG. 2 is a plan view of the personal watercraft of FIG. 1. In the embodiment described below, a water-jet propulsion personal watercraft is illustrated as the personal watercraft. It shall be appreciated that the present invention is applicable to water-jet propulsion personal watercraft, as well as to personal watercraft having a body which tends to tilt by a predetermined amount or more during acceleration and deceleration, and while turning, including personal watercraft having a relatively small body configured to accommodate one to three or four persons.

Turning now to FIGS. 1 and 2, a personal watercraft according to this embodiment has a body 1 including a hull 2 and a deck 3 covering the hull 2 from above. The hull 2 and the deck 3 are joined to each other over an entire periphery thereof by a gunnel line 4. In this embodiment, the gunnel line 4 is located above a waterline L (indicated by a two-dotted line in FIG. 1) of the watercraft when the watercraft is at rest in the water, and is substantially parallel to the waterline L.

As indicated by a broken line in FIG. 2, a deck opening 3A, which has a substantially rectangular shape as seen from above, is formed at a relatively rearward region located slightly rearward relative to the center of the deck 3 in an upper portion of the body 1 and is configured to extend in a longitudinal direction of the body 1. A straddle seat 7 is removably mounted over the deck opening 7. An engine room 6 is provided in a space defined by the hull 2 and the deck 3 below the seat 7. An engine E configured to drive the personal watercraft is mounted within the engine room 6.

As shown in FIG. 1, the engine E is mounted such that a crankshaft 10 extends along the longitudinal direction of the body 1. A rear end of the crankshaft 10 is integrally and rotatably coupled with a pump shaft 12 of a water jet pump P through a propeller shaft 11. An impeller 13 is attached on the pump shaft 12. The impeller 13 is covered with a cylindrical pump casing 15 on the outer periphery thereof.

A water intake 16 is provided on a bottom surface of the hull 2. The water outside the watercraft is sucked from the water intake 16 and is fed to the water jet pump P through a water passage 17. The water jet pump P pressurizes and accelerates the water by the impeller 13 and fairing vanes 14 guide water flow behind the impeller 13. The water is ejected through a pump nozzle 18 having a cross-sectional area of flow that is gradually reduced rearward, and from an outlet port 19. As the resulting reaction, the watercraft obtains a propulsion force.

As shown in FIG. 1, tilting sensors (attitude sensors) are mounted inside the body 1 and are configured to detect an attitude of the body 1. Specifically, these sensors may include a tilting sensor 5A configured to detect tilting in the longitudinal direction of the body 1, and a tilting sensor 5B configured to detect tilting in a lateral direction of the body 1. An ECU (electronic control unit) 30 is built into the body 1 and is communicatively coupled to the tilting sensors 5A and 5B. Signals detected by the tilting sensors 5A and 5B are sent to the ECU 30 (see FIG. 8). The ECU 30 is configured to control an operation of the engine E and to determine an attitude of the body 1 based on the signals from the tilting sensors 5A and 5B. The attitude sensors are not intended to be limited to the tilting sensors 5A and 5B, but may include other sensors such as a water contact sensor or other sensors, so long as they are capable of detecting a tilting state of the body 1 in the longitudinal direction or the lateral direction of the body 1.

In FIGS. 1 and 2, a bar-type steering handle 20 is coupled to a steering nozzle 21 positioned behind the pump nozzle 18 through a cable (not shown). The steering nozzle 21 is pivotable to the right or to the left around a pivot (not shown). The steering handle 20 cooperates with the steering nozzle 21. When the rider rotates the handle 20 clockwise or counterclockwise, the steering nozzle 21 pivots toward the opposite direction, and the watercraft can be correspondingly turned to any desired direction.

As shown in FIG. 1, a bowl-shaped reverse deflector 23 is mounted on an upper side of the steering nozzle 21 and is configured to be pivotable downward around a horizontally oriented pivot shaft 24. As shown in FIGS. 1 and 2, a rearward travel shift lever (shift lever) 27 is attached in the vicinity of the handle 20, for example at a location of the body 1 which is rightward and forward relative to the handle 20 and is configured to perform shifting between forward travel and rearward travel.

Figure 3:
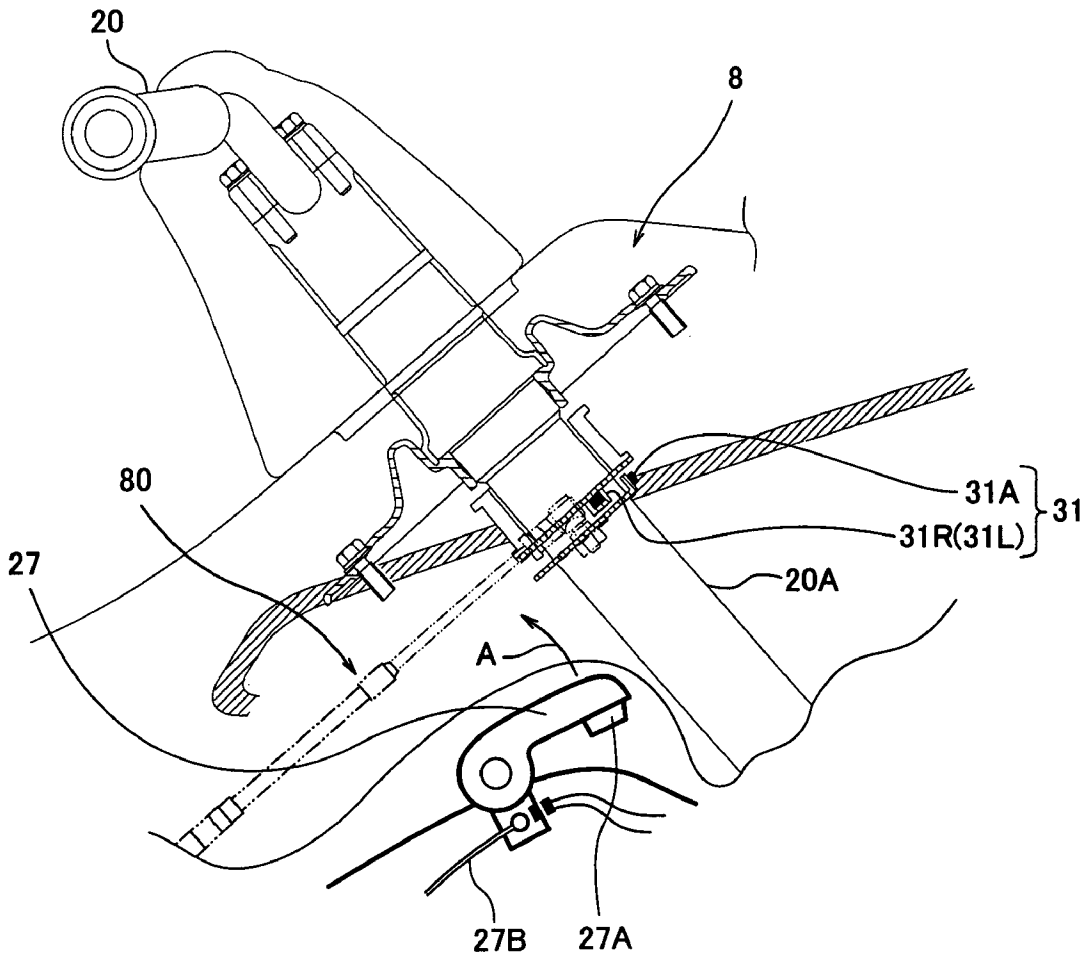
FIG. 3 is a partially enlarged cross-sectional view of FIG. 1, showing a steering system.

As shown in FIGS. 1 and 3, the shift lever 27 is pivotally mounted at a base end portion thereof to the body 1. The shift lever 27 has an unlock button 27A at a tip end portion thereof. The unlock button 27A is configured to lock and unlock a pivot operation of the shift lever 27. One end of a cable 27B is connected to the base end portion of the shift lever 27, and an opposite end thereof is connected to the deflector 23B. When the rider grips the shift lever 27 and causes the shift lever 27 to pivot in a direction as indicated by an arrow A while pushing the unlock button 27A with a finger of the rider, the cable 27B is pulled. This causes the deflector 23 to be pivoted to a downward position behind the steering nozzle 21, and the water jet ejected rearward from the steering nozzle 21 is changed to be ejected substantially forward. As a result, the watercraft transitions from forward travel to rearward travel. Under this condition, upon the rider releasing the unlock button 27A, the pivot operation of the shift lever 27 is locked, thereby maintaining the rearward travel. Further, upon the rider pushing the unlock button 27A in this state to cause the shift lever 27 to pivot in an opposite direction, the watercraft returns to the forward travel.

Figure 4:
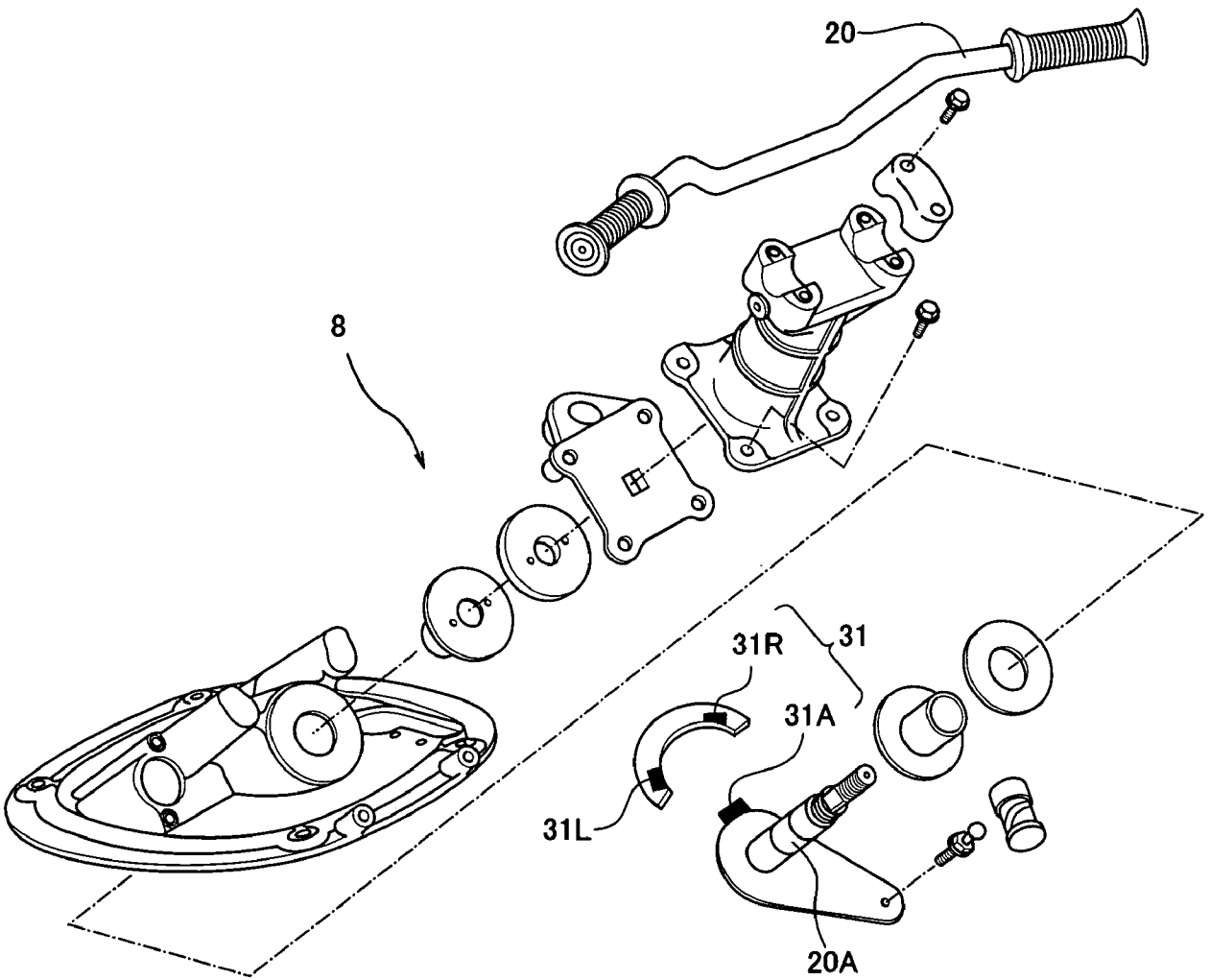
FIG. 4 is an exploded perspective view of the steering system of FIG. 3.

Turning to FIGS. 3 and 4, a steering system 8 of the personal watercraft according to the embodiment of the present invention is shown to include the handle 20, a steering column 20A configured to support the handle 20 at an upper end thereof and to extend downward, and a link mechanism 80 through which the steering column 20A is coupled to cooperate with the steering nozzle 21. A steering sensor 31 is attached to the steering system 8.

The steering sensor 31 includes a permanent magnet 31A, and left and right steering sensors 31L and 31R formed by proximity sensors. The permanent magnet 31A is attached to a position in a circumferential direction of a disc-shaped element securely mounted to a position of the steering column 20A. The steering sensors 31L and 31R are positioned to be spaced a predetermined angle (e.g., 20 degrees) apart clockwise (rightward) and counterclockwise (leftward) from the position where the permanent magnet 31A is attached.

When the handle 20 is rotated by the predetermined angle, the associated steering sensor 31L or 31R is close to the permanent magnet 31A, and thereby turns "ON", thus detecting that a steering operation has been performed. A signal from the steering sensor 31L or 31R is sent to the ECU 30 (see FIG. 7). The steering sensor 31 may include one or more of various switches such as a limit switch, or one or more of various sensors capable of detecting an angle, such as a potentiometer.

Figure 5:
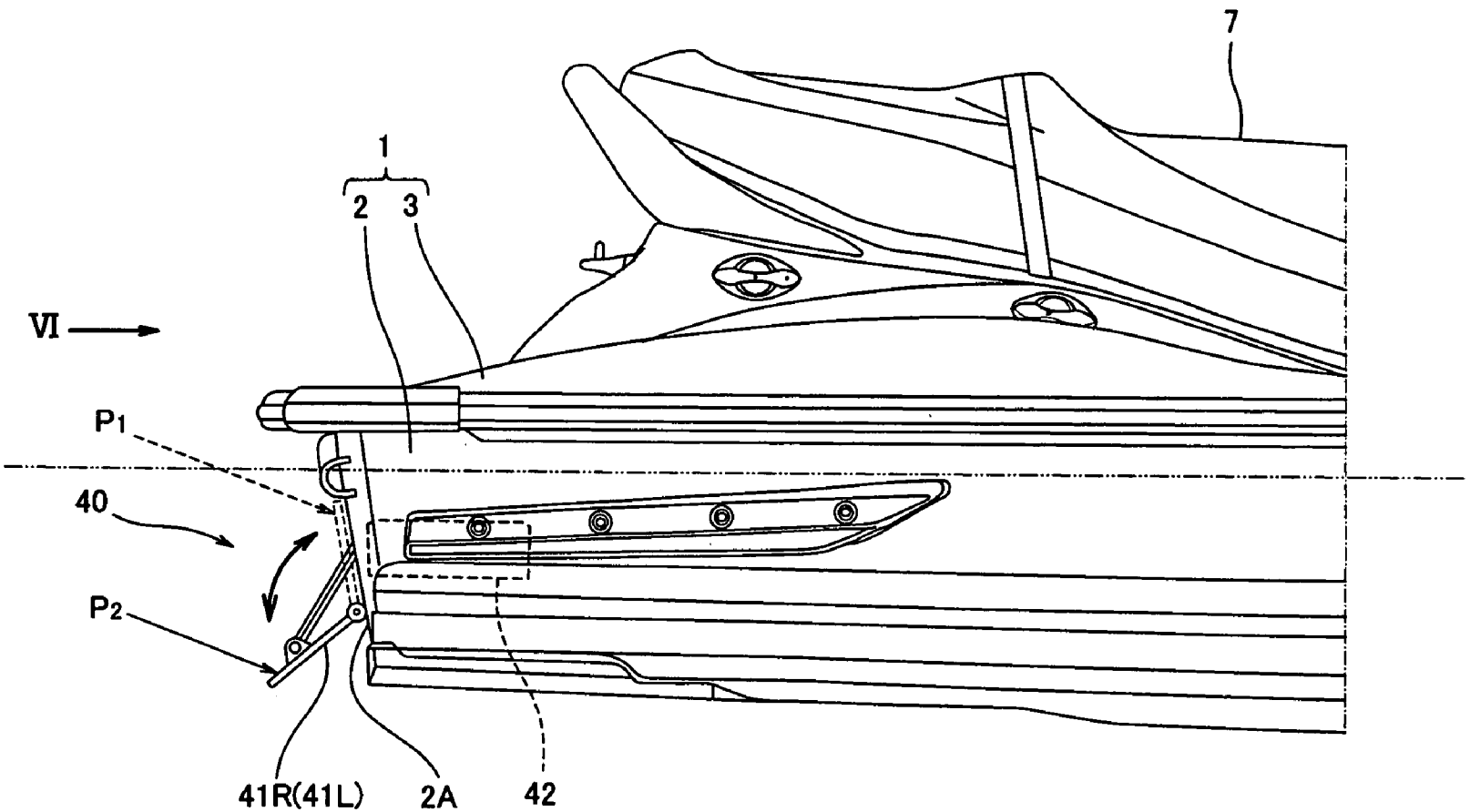
FIG. 5 is an enlarged side view of a rear portion of the personal watercraft of FIG. 1, showing a propulsion force changing system.
Figure 6:
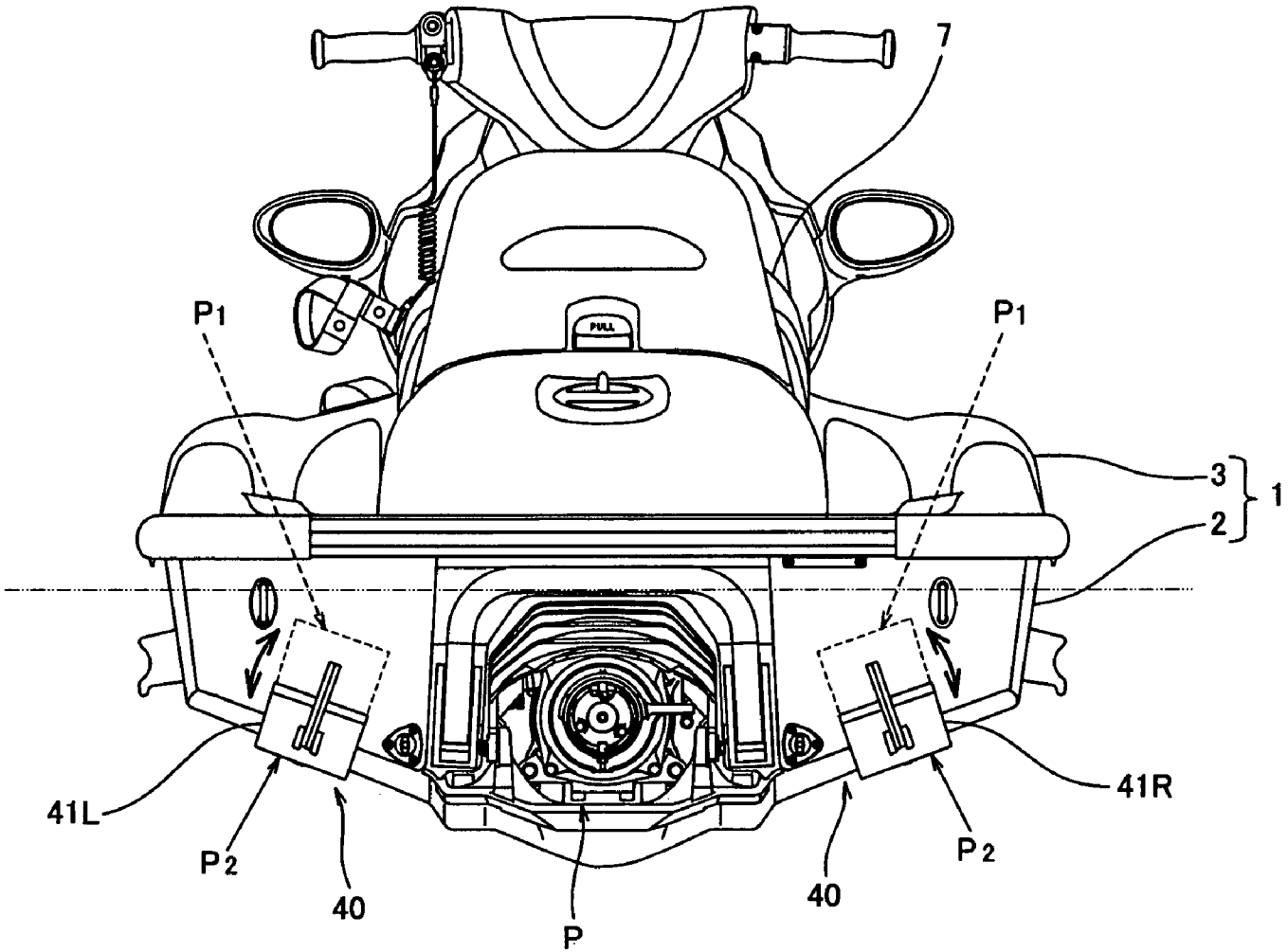
FIG. 6 is a view take in the direction of the arrow substantially along line VI of FIG. 5, showing the propulsion force changing system, as viewed from a rear face of the watercraft.

As shown in FIG. 5, a propulsion force changing system 40 is mounted at a rear portion of the body 1 and is configured to change a propulsion force of the watercraft. As shown in FIGS. 5 and 6, the propulsion force changing system 40 includes a left steering tab (movable tab) 41L and a right steering tab (movable tab) 41R which are mounted to a rear end portion of the hull 2, i.e., a rear end of the transom board 2A, and are configured to contact water. The propulsion force changing system 40 further includes a drive device 42 which is mounted in the rear portion inside the body 1 and which is configured to have an actuator such as a hydraulic cylinder configured to drive the steering tabs 41L and 41R. The drive device 42 is communicatively coupled to the ECU 30 as described later (see FIG. 7).

The steering tabs 41L and 41R are rectangular, and are driven by the drive device 42 to be vertically pivotable. Water resistance applied to the steering tabs 41L and 41R varies depending on positions of the steering tabs 41L and 41R. Therefore, the steering tabs 41L and 41R are capable of varying water resistance (propulsion resistance) which is applied to the body 1 of the watercraft during travel. More specifically, the steering tables 41L and 41R are vertically pivotable between an upper position $P_1$ in which the water resistance applied to the body 1 is low and a lower position $P_2$ in which the resistant is high. As used herein, the upper position $P_1$ refers to a position in which the steering tabs 41L and 41R are positioned to contact a rear side of the transom board 2A and are not subjected to water resistance, and the lower position $P_2$ refers to a position in which the steering tabs 41L and 41R protrude rearward from the transom board 2A and are subjected to water resistance of water flowing behind the transom board 2A.

The drive device 42 is configured to, in accordance with an instruction signal from the ECU 30, drive the steering tabs 41L and 41R to pivot together or individually between the upper position $P_1$ and the lower position $P_2$, thereby changing the propulsion resistance applied to the body 1 of the watercraft. The configuration of the steering tabs 41L and 41R shown in FIGS. 5 and 6 should not be interpreted as limiting, as other suitable configurations capable of increasing and decreasing the propulsion resistance applied to the body 1 may be employed.

Figure 7:
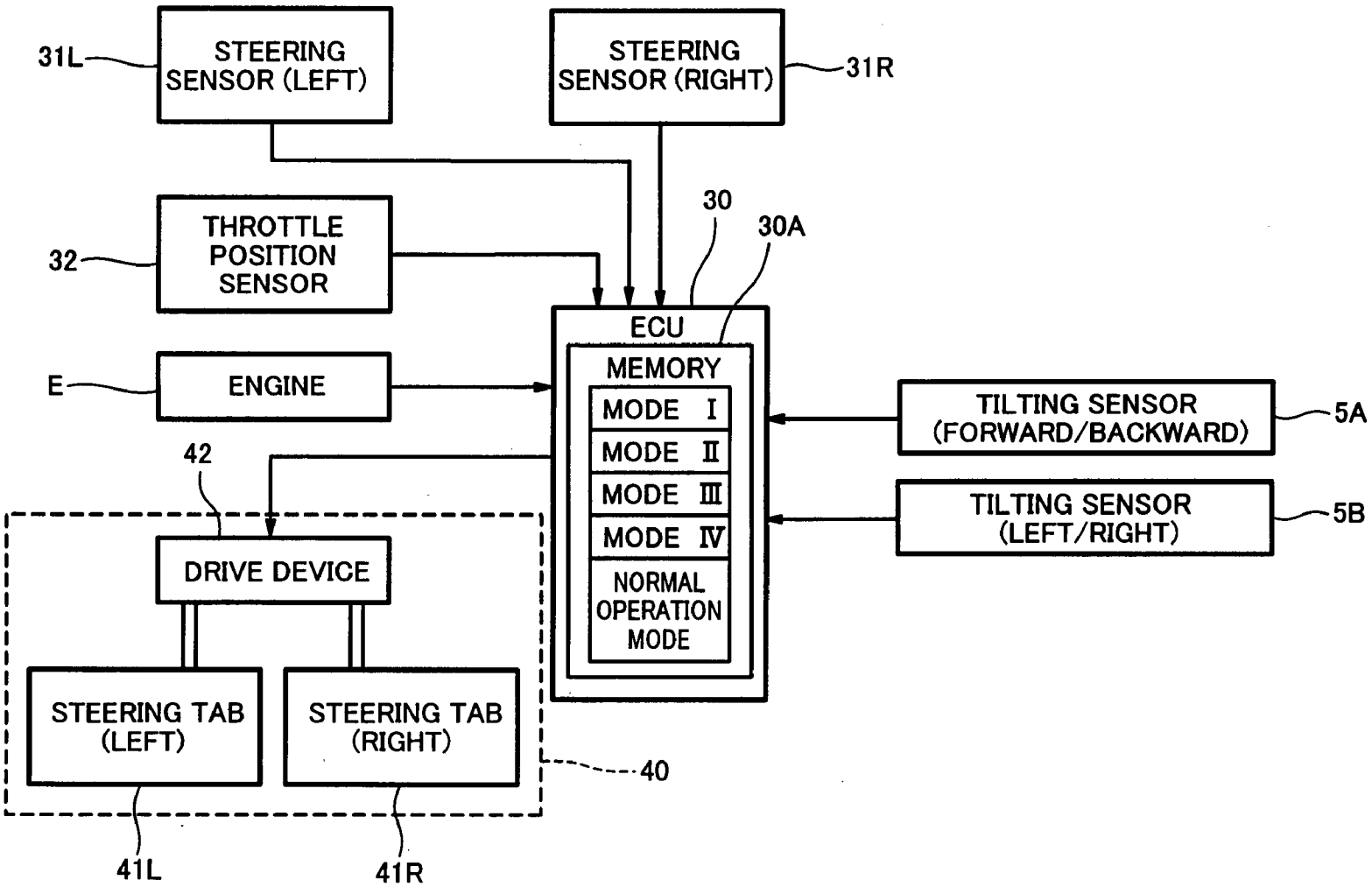
FIG. 7 is a block diagram showing a configuration of the watercraft of FIG. 1, including an ECU, an engine, the propulsion force changing system, and various sensors.

As described above, the ECU 30 is built into the personal watercraft. As shown in FIG. 7, the ECU 30 is communicatively coupled to the tilting sensors 5A and 5B, the steering sensors 31R and 31L, and the drive device 42 configured to drive the steering tabs 41L and 41R. Further, the ECU 30 is communicatively coupled to a throttle position sensor 32 configured to detect an open position (opening degree) of a throttle of the engine E and to serve as a throttle sensor of the present invention.

The throttle position sensor 32 is mounted to enable the ECU 30 to detect that the throttle of the engine E is in a fully closed position. A throttle sensor configured for this purpose may include one or more of various sensors, such as an engine speed sensor, a watercraft speed sensor, or an acceleration sensor. Exemplary configurations for these sensors are disclosed in (1) U.S. Pat. No. 6,551,152 owned by the applicant of the subject application, which was filed Jun. 8, 2001 and patented Apr. 22, 2003, (2) U.S. patent application No. 6,568,968 filed Aug. 2, 2001, and patented May, 27, 2003, (3) U.S. patent application Publication No. 2003-0066469-A1 filed in Sep. 17, 2001, and published Apr. 10, 2003, and (4) U.S. Pat. No. 6,589,085 filed Aug. 2, 2001, and patented Jun. 8, 2003, the entire disclosure of each of which is herein incorporated by reference for all purposes.

The above described "the throttle is in a fully closed position" is meant to include a state in which the throttle is in a substantially fully closed position, and/or a state in which the throttle is quickly closed to a great degree, as well as the state in which the throttle is fully closed, which are disclosed in the U.S. patents and published patent applications listed in the preceding paragraph, and incorporated by reference herein. Also, herein, an "operation for fully closing the throttle" refers to a rider's operation for causing the throttle to shift to these states.

The ECU 30 is configured to, in accordance with the detection signals from the tilting sensors 5A and 5B, determine whether the body 1 is in a state in which "the front part is tilting upward by a predetermined amount or more" during acceleration, "the front part is tilting downward by a predetermined amount or more" during deceleration, or "the body is banking by a predetermined or more" during a turn. In these cases, the ECU 30 is configured to control operations of the steering tabs 41L and 41R or the engine E to inhibit further change in the attitude of the body 1. Since the engine E is configured to change the propulsion force given to the watercraft according to the engine speed, it may be controlled to function as the propulsion force changing system, by the ECU 30, instead of or in addition to the steering tabs 41L and 41R and the drive device 42.

Further, the ECU 30 is configured to determine that "the throttle is fully closed" based on an open position of the throttle of the engine E which is received from the throttle position sensor 32, and to determine that the steering system 8 has been steered by a predetermined operation amount or more based on the detection signal received from the left steering sensor 31L or the right steering sensor 31R. The ECU 30 is configured to control the operation of the engine E to increase the propulsion force being generated by the water jet pump P in order to facilitate turning of the watercraft during low-speed travel.

In order to enable the ECU 30 to execute such control, a memory 30A built into the ECU 30 is configured to store control data regarding a normal operation mode, control data regarding a mode I for inhibiting further upward tilting of the front part of the body 1 during acceleration, control data regarding a mode II for inhibiting further downward tilting of the front part of the body 1 during deceleration, control data regarding a mode III for inhibiting further banking of the body 1 during a turn, and control data regarding a mode (steering assist mode) IV for assisting in turning of the body during low-speed travel.

Figure 8:
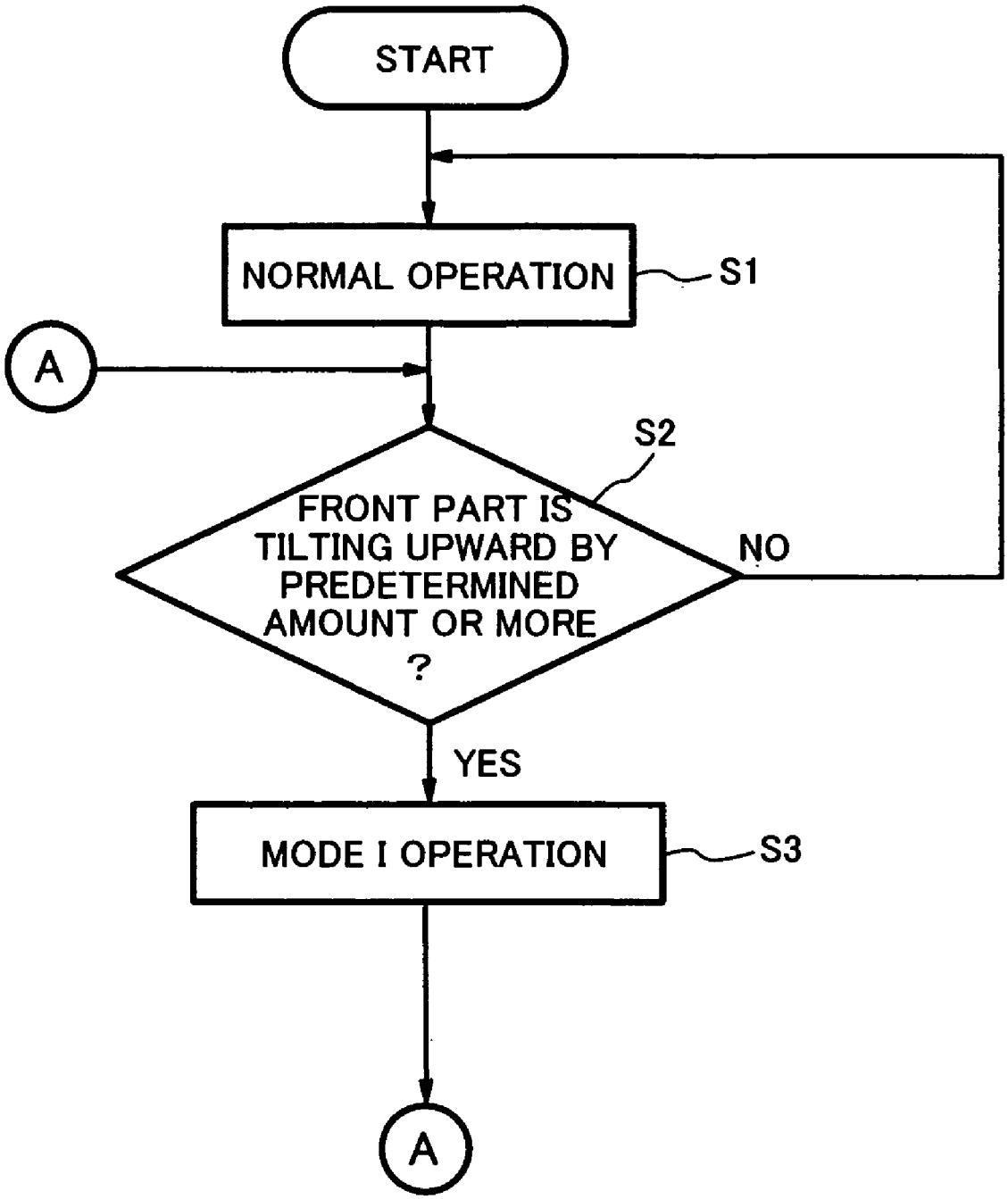
FIG. 8 is a flowchart showing an operation of the ECU during acceleration.

Referring to the flowchart of FIG. 8, an operation of the ECU 30 during acceleration will be described. The ECU 30 determines whether or not the front part of the body 1 is tilting upward by the predetermined amount or more based on the detection signal from the tilting sensor 5A when the ECU 30 is executing normal engine control (normal operation: S1) based on the control data regarding the normal operation mode stored in the memory 30A (S2).

As used herein, "normal operation" corresponds to control of the engine E executed by the ECU 30 without the control in any of the modes I to IV, for example, a normal control state of the engine E executed by the ECU 30 based on the open position of the throttle. The state of "normal operation" is disclosed in the specifications of the above mentioned published U.S. patent application and issued patents (1) to (4), which are herein incorporated by reference.

If it is determined that the front part of the body 1 is tilting upward by the predetermined amount or more in step S2 (step S2: YES), the ECU 30 is configured to control the drive device 42 based on the control data regarding the mode I which is stored in the memory 30A (step S3), and returns the process to step S2. In this case, for example, the ECU 30 executes control to cause the left steering tab 41L and the right steering tab 41R to be pivoted to the position $P_2$ in which the water resistance applied to the steering tabs 41L and 41R is higher, thereby inhibiting further upward tilting of the front part of the body 1. As a result, smooth acceleration is achieved.

It shall be appreciated that, during normal travel, the left steering tab 41L and the right steering tab 41R are in the position $P_1$ in which the water resistance is not substantially applied to these tabs. If it is determined that the front part of the body 1 is not tilting upward by the predetermined amount or more (Step 2: No), the ECU 30 returns the process to step S1, and executes control to continue the normal operation. In Step S3, in instead of or in addition to the control of the positions of the steering tabs 41L and 41R, the engine speed of the engine E may be controlled to decrease the propulsion force being generated by the water jet pump P.

Figure 9:
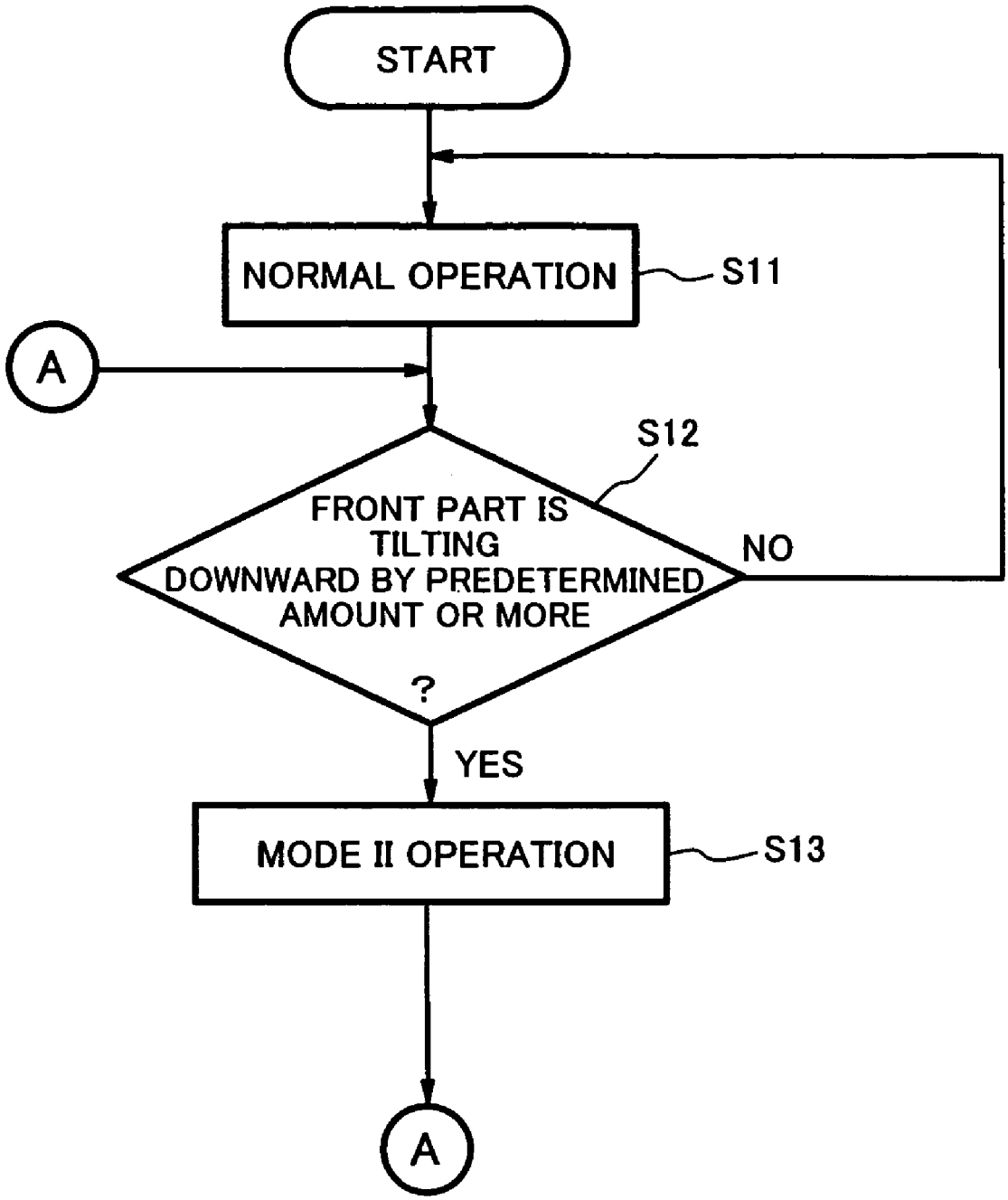
FIG. 9 is a flowchart showing an operation of the ECU during deceleration.

Referring to the flowchart of FIG. 9, an operation of the ECU 30 during deceleration will be described. The ECU 30 determines whether or not the front part of the body 1 is tilting downward by the predetermined amount or more based on the detection signal from the tiling sensor 5A when the ECU 30 is executing normal engine control (normal operation: S11) based on the control data regarding the normal operation mode stored in the memory 30A (step S12).

If it is determined that the front part of body 1 is tilting downward by the predetermined amount or more (step S12: YES), the ECU 30 controls the engine E based on the control data regarding the mode II stored in the memory 30A (step S13). For example, the ECU 30 temporarily increases the engine speed of the engine E to cause the water jet pump P to generate a propulsion force, thereby inhibiting further downward tilting of the front part of the body 1. Thereafter, the ECU 30 returns the process to step S12. On the other hand, if it is determined that the body 1 is not tilting downward by the predetermined amount or more in step S12 (Step S12: NO), the ECU 30 returns the process to step S11, and executes control to continue the normal operation.

In Step S13, instead of or in addition to the control of the engine E, the positions of the steering tabs 41L and 41R may be controlled. Specifically, if it is determined that the front part of the body 1 is tilting downward by the predetermined amount or more (step S12: YES) when the steering tabs 41L and 41R are in the position $P_2$ to facilitate deceleration during deceleration of the watercraft, these tabs 41L and 41R may be pivoted upward to the position $P_1$ to decrease the water resistance applied to the steering tabs 41L and 41R, instead of or in addition to temporarily increasing the engine speed of the engine E.

Figure 10:
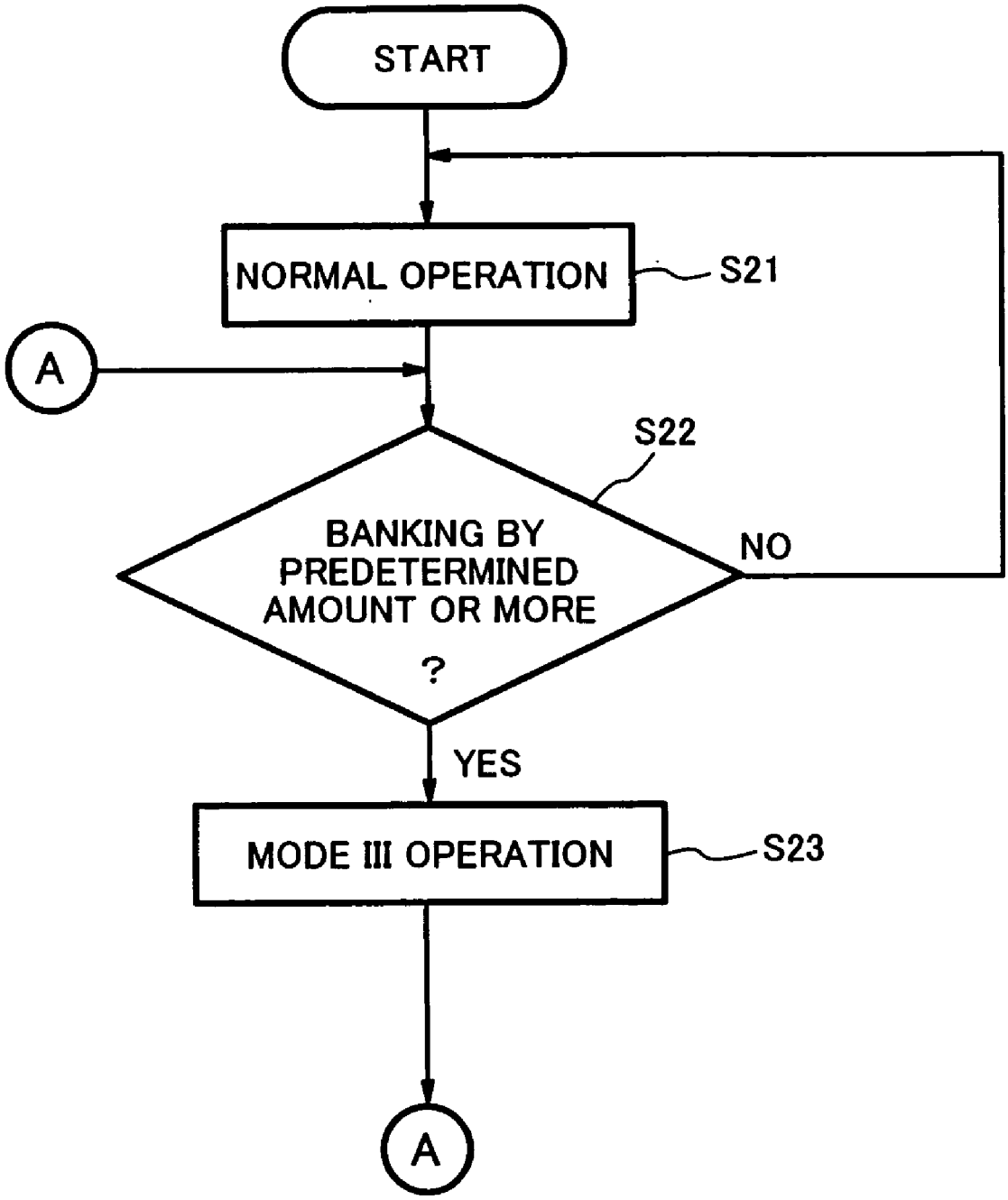
FIG. 10 is a flowchart showing an operation of the ECU during a turn.

Referring to a flowchart of FIG. 10, an operation of the ECU 30 during a turn will be described. The ECU 30 determines whether or not the body 1 is banking by a predetermined amount or more based on the detection signal from the tilting sensor 5B (step S22), when the ECU 30 is executing normal engine control (normal operation: S21) based on the control data regarding the normal operation mode stored in the memory 30A.

If it is determined that the body 1 is banking to one side (rightward or leftward) by the predetermined amount or more (step S22: YES), the ECU 30 controls the drive device 42 based the control data regarding the mode III stored in the memory 30A (step S23). For example, if it is determined that the body 1 is banking rightward by the predetermined amount or more, the left steering table 41L is pivoted downward to the position $P_2$ in which the water resistance applied to the steering tab 41L becomes higher. This increases water resistance applied to the left side of the body 1, thus inhibiting further rightward bank of the body 1. Thereafter, the ECU 30 returns the process to step S22. On the other hand, if it is determined that the body 1 is not tilting to one side by the predetermined amount or more in Step S22 (Step S22: NO), the ECU 30 returns the process to step S21, and executes control to continue the normal operation.

In Step S23, instead of or in addition to the control of the positions of the steering tabs 41L and 41R, the ECU 30 may control the engine speed of the engine E to cause the propulsion force being generated by the water jet pump P to decrease.

Figure 11:
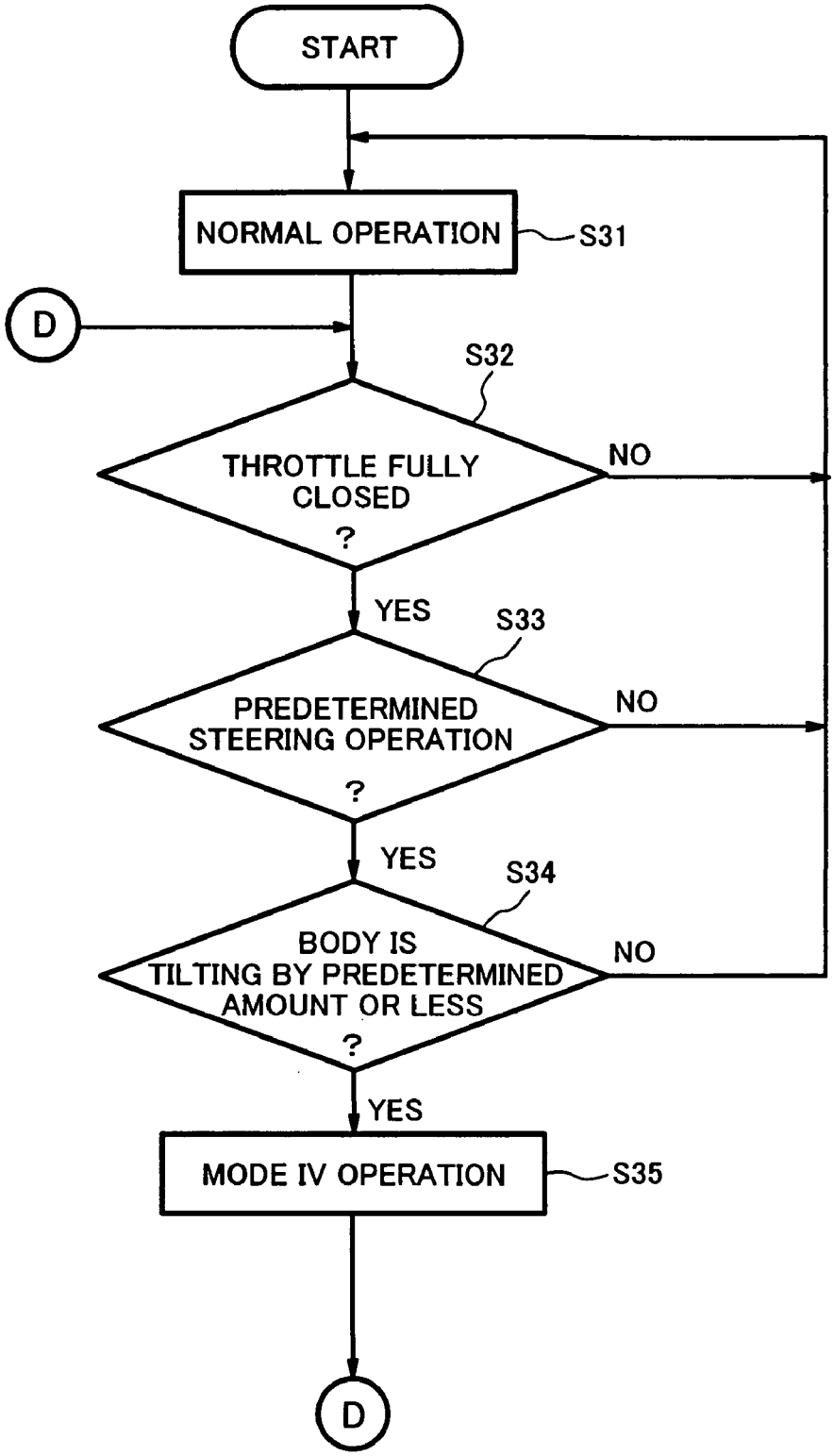
FIG. 11 is a flowchart showing an operation of the ECU during a low-speed turn.

Referring to a flowchart of FIG. 11, an operation of the ECU 30 during a low-speed turn will be described. The ECU 30 determines whether or not the operation for fully closing the throttle has been performed, based on the detection signal from the throttle position sensor 32 when the ECU 30 is executing control normal engine control (S31) based on the control data regarding the normal operation mode stored in the ECU 30 (step S32). If it is determined that the operation for fully closing the throttle has been performed (step S32: YES), the ECU 30 further determines whether or not the steering system 8 has been steered by a predetermined operation amount or more based on the detection signal from the left steering sensor 31L or the right steering sensor 31R (step S33). If it is determined that the steering system 8 has been steered by the predetermined operation or more (Step S33: YES), the ECU 30 further determines whether or not the body 1 is tilting by a predetermined amount or less based on the detection signal from the tilting sensor 5A or 5B (step S34).

If it is determined that the throttle is not in the fully closed position (step S32: NO), the steering system has not been steered by the predetermined operation or more (step 33: NO), or the body is not tilting by the predetermined amount or less (Step S34: NO), the ECU 30 returns the process to step S31 and executes control to continue the normal operation.

If it is determined that the body 1 is tilting by the predetermined amount or less (step S34: YES), the ECU 30 executes control to transition to a steering assist mode based on the control data regarding the mode IV stored in the memory 30A. For example, the ECU 30 temporarily increases the engine speed of the engine E and drives the water jet pump P to eject a water jet from the steering nozzle 21, or otherwise pivots the associated steering tab downward to the lower position $P_2$. This makes it easy for the watercraft to turn even during the low-speed travel.

Various examples of the control for increasing the engine speed are disclosed in the specifications of the above mentioned published U.S. patent applications and patents (1) to (4), which are herein incorporated by reference.

While the steering tabs 41L and 41R are configured to be pivoted between the upper position $P_1$ and the lower position $P_2$ at which higher water resistance is generated, it will be understood that the illustrated lower position $P_2$ is merely exemplary, and that a variety of other suitable lower positions may be defined depending on desired water resistance.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft configured to plane on a water surface, comprising:

an attitude sensor configured to detect an attitude of a body of the watercraft;

a water jet pump configured to generate a propulsion force of the watercraft, the water jet pump being driven by an engine to generate the propulsion force; and a controller configured to control the attitude of the body in such a manner that the controller changes an engine speed of the engine according to a signal output from the attitude sensor to cause the propulsion force generated by the water jet pump to be changed.

2. The personal watercraft according to claim 1, wherein the controller is configured to decrease the engine speed of the engine to decrease the propulsion force of the watercraft which is generated by the water jet pump so as to inhibit a front part of the body from further tilting upward when the signal output from the attitude sensor indicates that the front part of the body is tilting upward by a first predetermined amount or more.

3. The personal watercraft according to claim 2, further comprising:

a movable tab configured to change propulsion resistance generated by contact with water and applied to the watercraft;

wherein the controller is configured to be able to, simultaneously, control the movable tab to increase the propulsion resistance applied to the watercraft and to control the engine to decrease the propulsion force of the watercraft which is being generated by the water jet pump when the signal output from the attitude sensor indicates that the front part of the body is tilting upward by the first predetermined amount or more.

4. The personal watercraft according to claim 1, wherein the controller is configured to increase the engine speed of the engine to increase the propulsion force of the watercraft which is generated by the water jet pump so as to inhibit a front part of the body from further tilting downward when the signal output from the attitude sensor indicates that the front part of the body is tilting downward by a second predetermined amount or more.

5. The personal watercraft according to claim 4, further comprising:

a throttle sensor configured to detect that an operation for fully closing a throttle of the engine has been performed; and a steering sensor configured to detect that a steering system has been steered by a predetermined operation amount or more;

wherein the controller is configured to execute a steering assist mode, in which the controller controls the engine to increase the engine speed when the throttle sensor detects that the operation for fully closing the throttle has been performed and the steering sensor detects that the steering system has been steered by the predetermined operation amount or more; and wherein the controller is configured to be able to further control the engine to increase the engine speed when the attitude sensor detects that the front part of the body is tilting downward by the second predetermined amount or more during the steering assist mode.

6. The personal watercraft according to claim 4, further comprising:

a movable tab configured to change propulsion resistance generated by contact with water and applied to the watercraft;

wherein the controller is configured to be able to, simultaneously, control the movable tab to decrease the propulsion resistance applied to the watercraft and control the engine to increase the propulsion force of the watercraft which is being generated by the water jet pump when the signal output from the attitude sensor indicates that the front part of the body is tilting downward by the second predetermined amount or more.

7. The personal watercraft according to claim 1, wherein the controller is configured to decrease the engine speed of the engine to decrease the propulsion force of the watercraft which is generated by the water jet pump to inhibit further bank of the body when the signal output from the attitude sensor indicates that the body is banking by a third predetermined amount or more.

8. The personal watercraft according to claim 7, further comprising:

a throttle sensor configured to detect that an operation for fully closing a throttle of the engine has been performed; and a steering sensor configured to detect that a steering system has been steered by a predetermined operation amount or more;

wherein the controller is configured to execute a steering assist mode, in which the controller controls the engine to increase the engine speed to assist in steering when the throttle sensor detects that the operation for fully closing the throttle has been performed and when the steering sensor detects that the steering system has been steered by the predetermined operation amount or more;

wherein the controller is configured to be able to further control the engine to decrease the engine speed when the attitude sensor detects that the body is banking by the third predetermined amount or more during the steering assist mode.

9. The personal watercraft according to claim 7, further comprising:

a movable tab configured to change propulsion resistance generated by contact with water and applied to the watercraft;

wherein the controller is configured to be able to, simultaneously, control the movable tab to inhibit further bank of the body and to control the engine to decrease the propulsion force of the watercraft which is being generated by the water jet pump when the signal output from the attitude sensor indicates that the body is banking by the third predetermined amount or more.

10. The personal watercraft according to claim 7, further comprising:

a water intake that is provided at a bottom of the body and is configured to be connected to the water jet pump;

wherein the third predetermined amount is a bank angle of the body at which the water intake is substantially exposed on a water surface.

* * * * *